US010638816B2

(12) United States Patent
Strum et al.

(10) Patent No.: US 10,638,816 B2
(45) **Date of Patent: *May 5, 2020**

(54) VERSATILE PROTECTIVE OUTERWEAR

(71) Applicant: Velocity Systems LLC, Dulles, VA (US)

(72) Inventors: David B. Strum, Amissville, VA (US); David M. Duncan, Leesburg, VA (US)

(73) Assignee: Velocity Systems LLC, Dulles, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/885,893

(22) Filed: Feb. 1, 2018

(65) Prior Publication Data

US 2018/0168289 A1 Jun. 21, 2018

Related U.S. Application Data

(63) Continuation of application No. 14/594,734, filed on Jan. 12, 2015, now Pat. No. 9,894,962.

(60) Provisional application No. 61/925,812, filed on Jan. 10, 2014.

(51) Int. Cl.

| | |
|---|---|
| ***A44B 11/00*** | (2006.01) |
| ***A41F 15/00*** | (2006.01) |
| ***A41F 15/02*** | (2006.01) |
| ***F41H 1/02*** | (2006.01) |

(52) U.S. Cl.

CPC ..... *A44B 11/006* (2013.01); *A41F 15/002* (2013.01); *A41F 15/02* (2013.01); *F41H 1/02* (2013.01); *Y10T 24/40* (2015.01); *Y10T 24/4088* (2015.01); *Y10T 24/4093* (2015.01); *Y10T 29/49826* (2015.01)

(58) Field of Classification Search

CPC ..... A44B 11/006; F41H 1/02; A41F 15/02; A41F 15/002; Y10T 24/40; Y10T 24/4093; Y10T 29/49826; Y10T 24/4088

See application file for complete search history.

(56) References Cited

U.S. PATENT DOCUMENTS

| | | | | |
|---|---|---|---|---|
| 2,817,844 A * | 12/1957 | Komar | A41F 15/002 | 2/323 |
| 3,077,650 A * | 2/1963 | Horne | A41F 15/002 | 24/200 |
| 3,891,996 A * | 7/1975 | Leach | F41H 1/02 | 2/2.5 |
| 7,814,567 B2 * | 10/2010 | Dovner | F41H 1/02 | 2/2.5 |
| 8,256,020 B2 * | 9/2012 | Dovner | F41H 1/02 | 2/2.5 |

(Continued)

*Primary Examiner* — Robert Sandy
*Assistant Examiner* — Louis A Mercado
(74) *Attorney, Agent, or Firm* — Williams Mullen; Thomas F. Bergert

(57) ABSTRACT

A shoulder strap device and method provides a movable and/or swiveling attachment arrangement which spreads the load to the wearer's specific shape. Embodiments of the device include a set of strap ring components, each strap ring component having a substantially linearly extending base portion and a substantially curvilinearly extending retention portion, first and second connector items or straps secured to respective subsets of the strap ring components, and a body garment secured to the strap ring components.

10 Claims, 5 Drawing Sheets

(56) References Cited

U.S. PATENT DOCUMENTS

| | | | | |
|---|---|---|---|---|
| 8,528,112 | B2 * | 9/2013 | Blauer | F41H 1/02 2/102 |
| 8,776,262 | B2 * | 7/2014 | Blauer | F41H 1/02 2/102 |
| 9,162,089 | B2 * | 10/2015 | Harshbarger | A62B 35/0006 |
| 2002/0145279 | A1 * | 10/2002 | Murray | B60R 22/105 280/801.1 |
| 2006/0026805 | A1 * | 2/2006 | Johnson | F41C 23/02 24/302 |
| 2006/0094335 | A1 * | 5/2006 | Fildan | A41C 3/00 450/58 |
| 2006/0094336 | A1 * | 5/2006 | Fildan | A41C 3/00 450/92 |
| 2006/0252347 | A1 * | 11/2006 | Fildan | A41F 15/002 450/86 |
| 2010/0235957 | A1 * | 9/2010 | Dovner | F41H 1/02 2/2.5 |
| 2010/0306897 | A1 * | 12/2010 | Wood | A41D 13/02 2/79 |
| 2011/0023203 | A1 * | 2/2011 | Dovner | F41H 1/02 2/2.5 |
| 2011/0179539 | A1 * | 7/2011 | Dovner | F41H 1/02 2/2.5 |
| 2011/0215126 | A1 * | 9/2011 | Madsen Thatcher | A45F 4/00 224/579 |
| 2012/0017347 | A1 * | 1/2012 | Strum | A41D 13/0007 2/69 |
| 2012/0018477 | A1 * | 1/2012 | Inouye | A45F 3/06 224/576 |
| 2012/0174280 | A1 * | 7/2012 | Strum | F41H 1/02 2/69 |
| 2014/0352858 | A1 * | 12/2014 | DeWitt | A45C 13/02 150/110 |

* cited by examiner

VERSATILE PROTECTIVE OUTERWEAR

REFERENCE TO RELATED APPLICATIONS

This application is a continuation of U.S. application Ser. No. 14/594,734, filed on Jan. 12, 2015, now U.S. Pat. No. 9,894,962, which claims the benefit of U.S. Provisional Application No. 61/925,812, filed on Jan. 10, 2014, the disclosures of which are incorporated by reference herein in their entireties.

FIELD OF THE INVENTION

The present invention pertains to armor-enhanceable, personal, wearable devices, and more particularly to a versatile strap apparatus for use with such devices.

BACKGROUND OF THE INVENTION

Military and law enforcement personnel have employed armor-enhanced clothing in order to protect their bodies from gunfire, shrapnel, explosive devices and other harmful ballistic objects. For example, vests, plate carriers, backpack carriers and other upper torso outerwear devices can be enhanced with armor and can come in all shapes and sizes with a variety of optional accessories. In many instances, such devices including multiple plies of material that can be joined along edges to create openings or pockets therein. Such personal wearable devices can also include attachment subsystems such as molle panels and the like, which allow the wearer to attach equipment, gear and even other equipment holders to the device. Examples of such upper torso outerwear devices can be seen, for example, in U.S. Patent Application Publication Nos. 20120174280 to Strum et al., and 20120017347 to Strum et al., the disclosures of which are incorporated herein by reference.

However, even when such clothing is sized according to individual specifications (for example, small, medium and large), the armor-enhanced clothing does not generally fit well, gets bunched up, prohibits smooth movement, results in undesirable gaps between body and clothing, has limited contact points with the body, does not wick sweat and water away, becomes uncomfortable and even hinders the withdrawal and operation of firearms. In specific environments where a user needs to lean in one direction or another, such upper torso outerwear can become inflexible and can restrict or even prevent proper body posturing to carry out desired tasks. For example, when personnel need to lean towards a trigger-firing arm when preparing to discharge a weapon, a rigid upper torso outerwear element might lift up or "post" above the user's shoulder and towards the user's head as the user leans to one side. Such lifting may make it awkward for the user to attain a comfortable and familiar firing position, and may require the user to push down on the outerwear with his or her head to try to counter the lifting force.

Further, shoulder strap systems in the past have been sewn in a fixed and generic angle that may or may not lay on the wearer's shoulders properly. When the shoulder straps are not laying flat and distributing load over the entire surface of the strap, only a leading edge of the strap is taking the hanging load. When the edge takes the load, the wearer can experience pain and discomfort, particularly with armor-enhanced clothing.

Such disadvantages often result in poor performance and can encourage mis-use or even non-use of these protective devices.

SUMMARY OF THE INVENTION

The present invention helps to overcome the current shortcomings and more. The present invention provides, in part, a shoulder strap apparatus and method that allows for extreme comfort due to a movable and/or swiveling attachment arrangement which spreads the load to the wearer's specific shape.

Embodiments of the device include a set of strap ring components, each strap ring component having a substantially linearly extending base portion and a substantially curvilinearly extending retention portion, first and second connector items or straps secured to respective subsets of the strap ring components, and a body garment secured to the strap ring components.

DETAILED DESCRIPTION OF EMBODIMENTS OF THE PRESENT INVENTION

Figure 1:
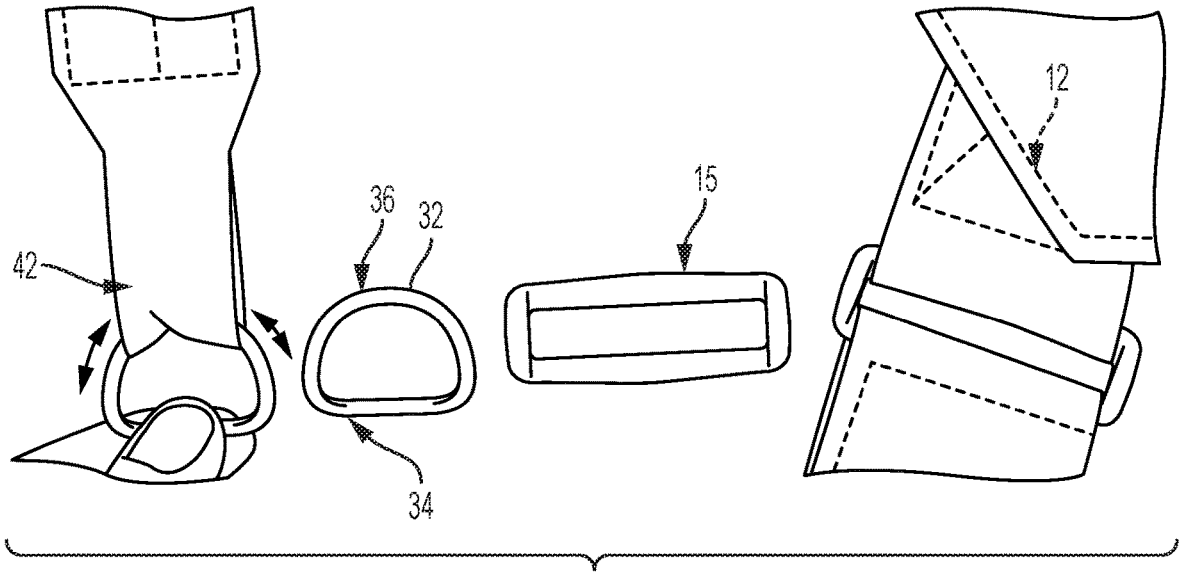
FIG. 1 is a photograph of a front side of a past attachment fixed element and one embodiment of the swivel element of the present invention.
Figure 2:
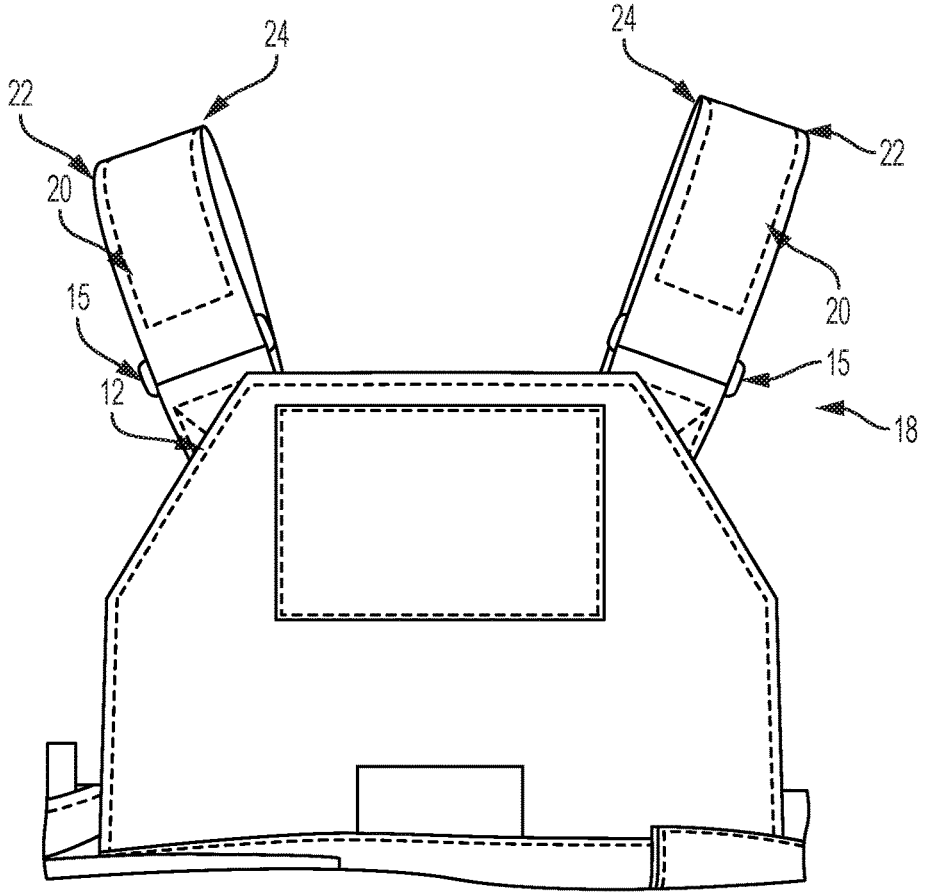
FIG. 2 is a photograph of a front side of a past attachment fixed element.
Figure 3:
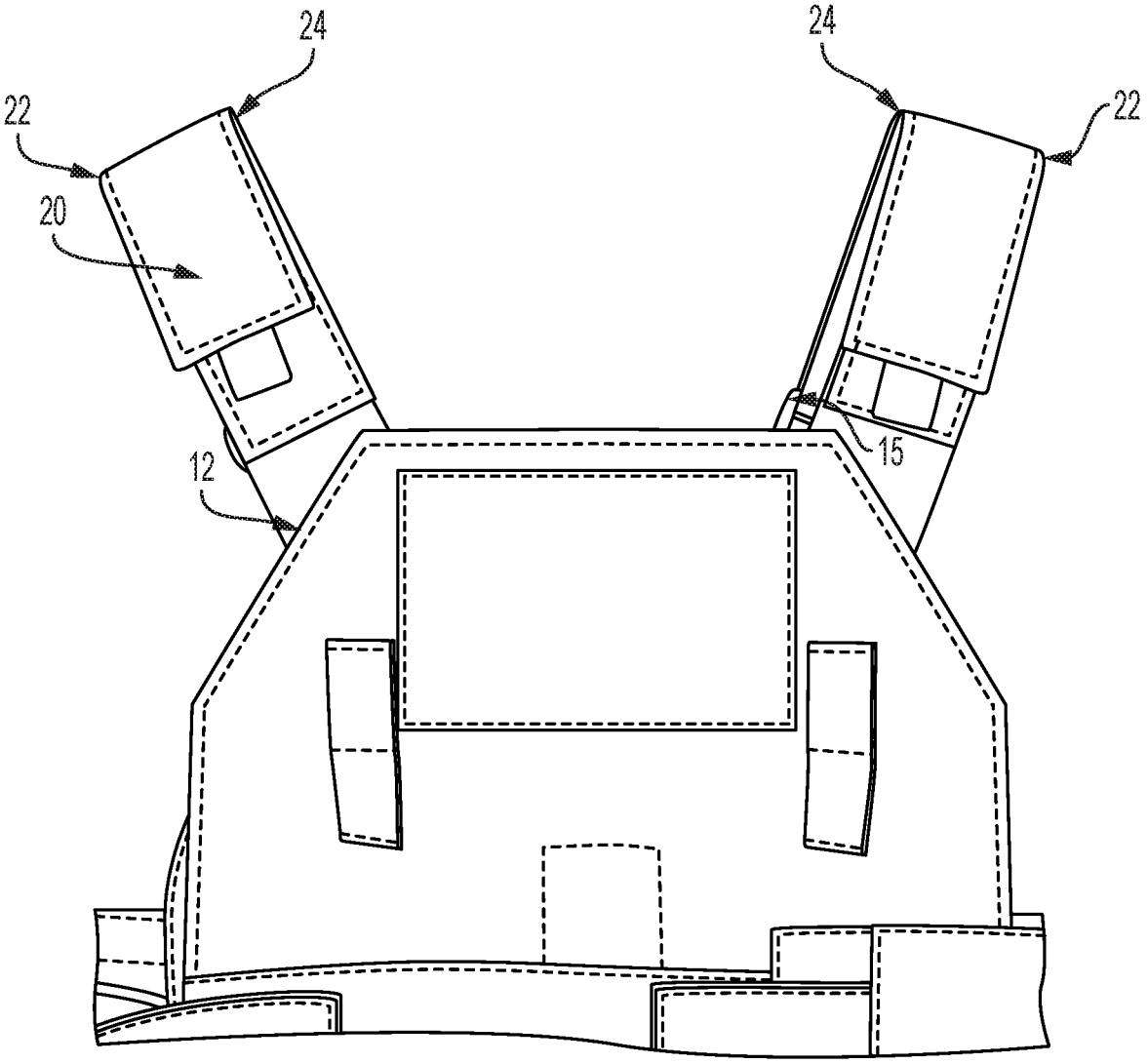
FIG. 3 is a photograph of a back side of a past attachment fixed element.
Figure 4:
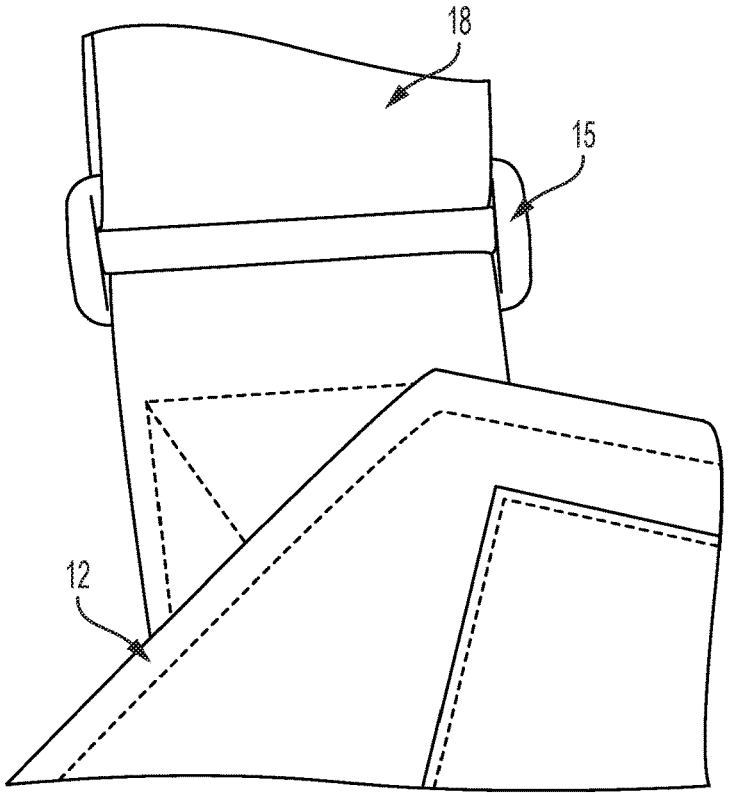
FIG. 4 is a photograph showing a past sewn and fixed loop element.

As shown in FIGS. 1 through 4, past systems have generally employed sewn 12 and fixed loop 15 elements on shoulder strap systems 18 that may or may not lay on the wearer's shoulders properly. When the shoulder straps 20 are not laying flat and distributing load over the entire surface of the strap, only a leading edge of the strap (e.g., 22 or 24) is taking the hanging load. When the edge takes the load, the wearer can experience pain and discomfort, particularly with armor-enhanced clothing.

Figure 6:
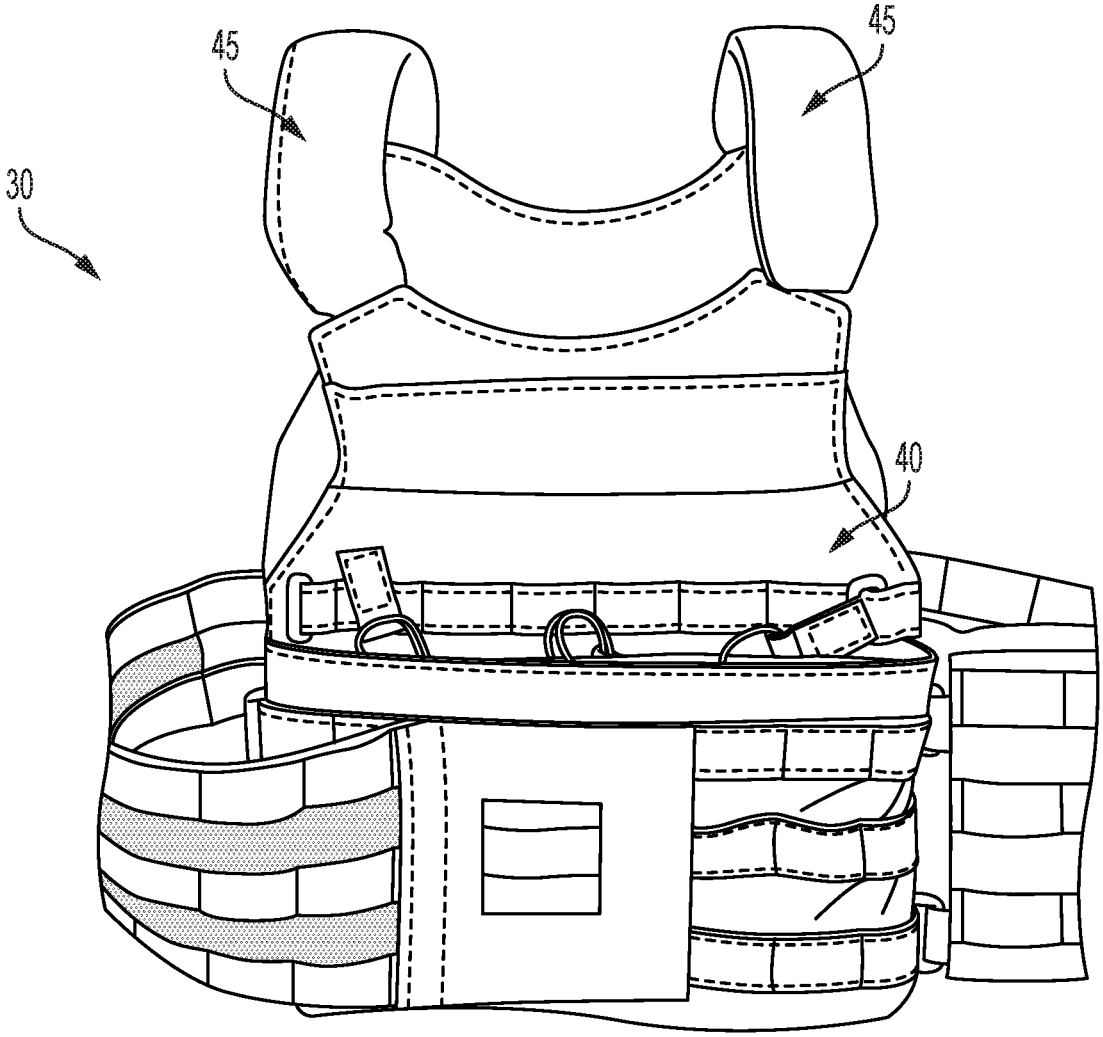
Figure 7:
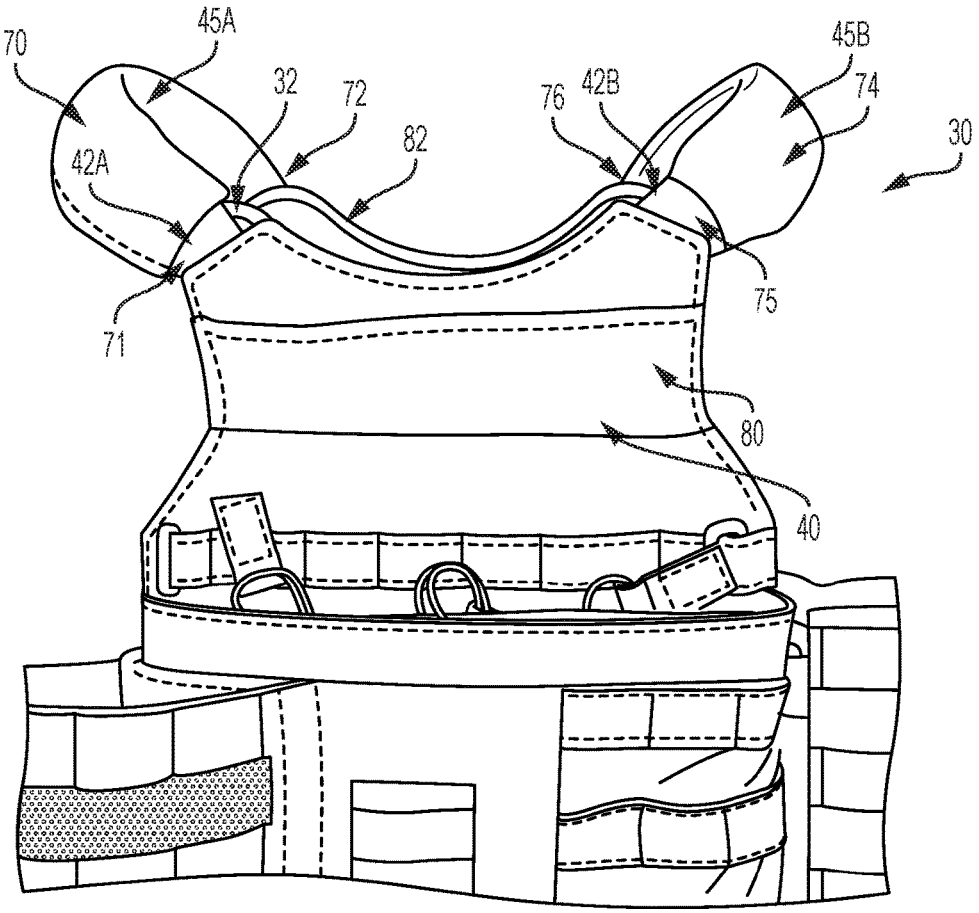
Figure 8:
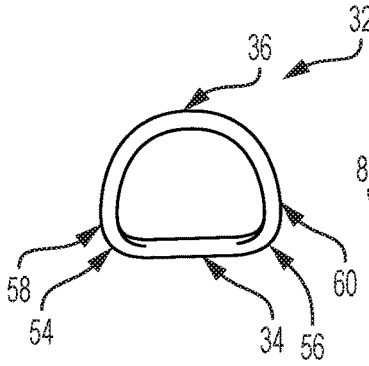
FIG. 8 is a photograph of a strap ring component according to embodiments of the present invention.
Figure 9:
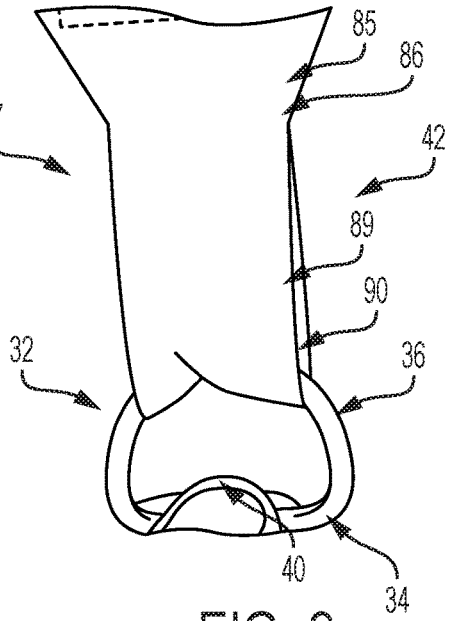
FIG. 9 is a photograph of a connector item slidingly secured to a strap ring component in accordance with embodiments of the present invention.

By contrast, as shown in FIGS. 1 and 5 through 9, embodiments of the present invention provide an apparatus 30 and strap ring component 32 that allows for extreme comfort to the wearer. The ring component 32 can have a solid metal or heavy plastic construction, and includes a base portion 34 and a substantially C-shaped retention portion 36, giving the full ring 32 a substantially D-shaped, closed loop construction. As shown in FIGS. 8 and 9, for example, the base portion 34 of each strap ring component has first 54 and second 56 ends and extends substantially linearly from the first end 54 to the second end 56. The retention portion 36 has first 58 and second 60 ends and extends substantially curvilinearly from the first end 58 to the second end 60, with the first end 58 of the retention portion 36 being integrally formed with the first end 54 of the base portion 34, and with the second end 60 of the retention portion 36 being integrally formed with the second end 56 of the base portion 34, such that the strap ring base 34 and retention 36 portions form a substantially D-shape, as shown in FIG. 8. By being integrally formed, or monolithic, the strap ring component 32 provides a strong a durable device that prevents connector items from coming loose during operation. In various embodiments of the present invention, the strap ring component 32 can be provided with a connection that is capable of opening, such as to allow a strap member or other connector item to be inserted and released. Such an embodiment of the strap ring component 32 can include, for example, a clip, threaded ring element, hinged first end 54 or other arrangement.

As shown in FIGS. 6 through 9, the base portion 34 can securely attach to a body garment 40 (or element 41 thereof), while the retention portion 36 can retain a connector item 42 such as a shoulder strap, for example, and allow the shoulder strap 42 to move along the entire body of the retention portion 36, as illustrated by the dual-ended arrows in FIG. 1. The connector items 42 can be maintained within a covering shoulder harness 45 in embodiments of the present invention, as shown in FIGS. 6 and 7. The device can comprise the ring component 32, alone, or in conjunction with connector item 42 and/or garment 40. In one aspect of the present invention, a method of providing the device of the present invention comprises forming the ring component 32, providing a connector item 42 such as a strap, providing a body garment, securing the garment to the base portion 34 of the ring 32, and securing the strap 42 to the retention portion 36 of the ring 32.

It will be appreciated that embodiments of the present invention the apparatus can comprise four strap ring components 32, two connector items 42 and a garment body portion 40, where the first and second connector items 42 are secured to respective subsets of the strap ring components 32. As shown in FIG. 7, for example, connector item 70 has a first end 71 and a second end 72, connector item 74 has a first end 75 and a second end 76, with the first end 71 of the first connector item 70 being secured to the retention portion of a first one of the strap ring components, with the second end 72 of the first connector item 70 being secured to the retention portion of a second one of the strap ring components, with the first end 75 of the second connector item 74 being secured to the retention portion of a third one of the strap ring components, and with the second end 76 of the second connector item 74 being secured to the retention portion of a fourth one of the strap ring components. The body garment 40 can be secured to the strap ring components, such that the front side 80 of the body garment is secured to the base portion of the first and third strap ring components, and with the back side 82 of the body garment is secured to the base portion of the second and fourth strap ring components. It will be appreciated that the strap ring components in FIG. 7 are secured at the ends 71, 72, 75, 76 of the respective connector items 70, 74, despite not all being shown in FIG. 7.

Figure 10:
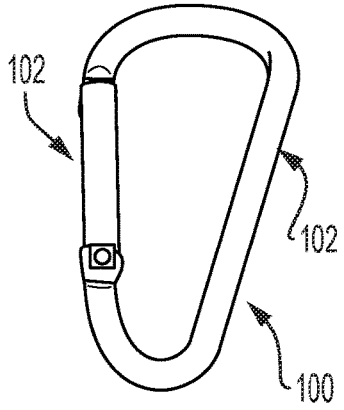
FIG. 10 is a depiction of a form of clip for use in embodiments of the present invention.

It will be appreciated that different connector items can be employed other than full straps, such as clips, belts and/or belt systems or other types of connectors. In various embodiments as shown in FIG. 9, for example, the connector item 42 can comprise a strap body portion 85 with an intermediate hitch element 86 at or near its first end 87 and second end (not shown). As shown in FIG. 9, the hitch element 86 is a sewn seam, but it will be appreciated that the hitch element can be embodied in other forms, such as a clip, fixed loop or other connector. At the ends, such as end 87, a retention portion engaging element 89 is provided. This element 89 can be a strap that is folded back upon itself so as to form a loop with an interior surface 90 that engages the retention portion 36 of the strap ring component 32. It will be appreciated that the retention portion engaging element 89 can be embodied in versions other than a strap-like material, such as a clip 100 with a base 102 and a biased, hinged latch 104 as shown in FIG. 10, so long as it forms a loop having an internal surface that slidingly and/or movingly engages the retention portion 36 of the strap ring component 32.

Figure 5:
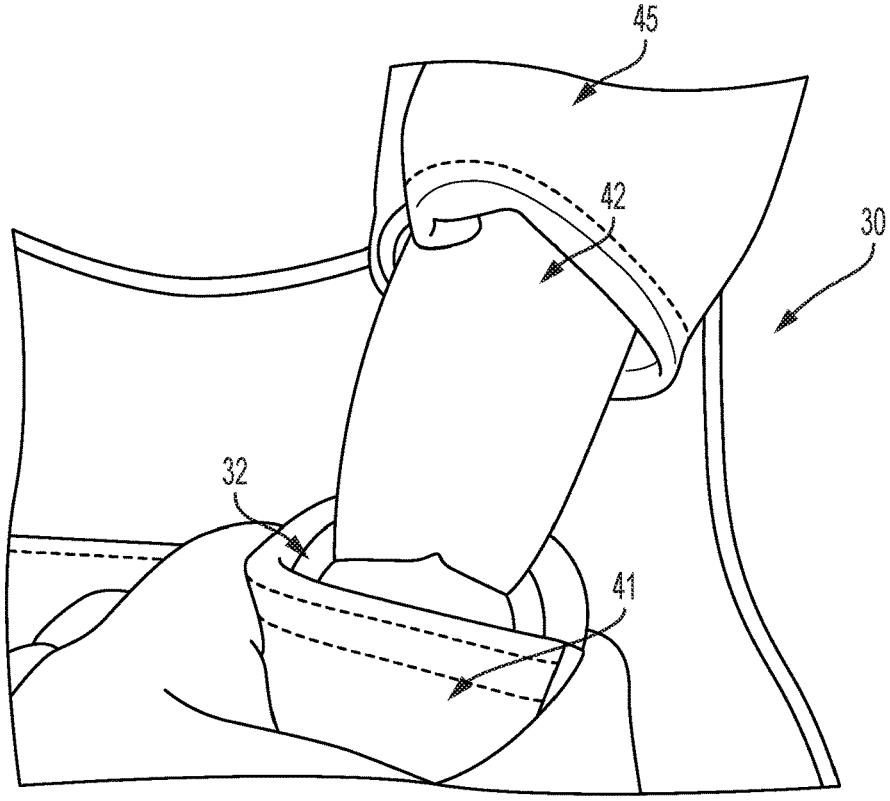
FIGS. 5 through 7 are photographs showing a swivel strap arrangement in accordance with embodiments of the present invention.

As shown in FIG. 7, a first shoulder harness 45A is secured around the first connector item 42A, and a second shoulder harness 45B is secured around the second connector item 42B. FIG. 6 shows the shoulder harnesses 45 completely covering the connector items. In various embodiments of the present invention, as shown in FIG. 5, for example, a protective or padded cuff element 41 can be provided as part of the body garment, and this element 41 can receive a strap ring component 32 to protect it from wear and tear, while also protecting the user and the user's remaining outer covering.

It should be understood that the foregoing description and examples are only illustrative of the present invention; the optimum dimensional relationships for the parts of the invention, including variations in size, materials, shape, form, function and the manner of operation, assembly and use, are deemed readily apparent to one skilled in the art, and all equivalent relationships to those illustrated in the drawings and described in the specification are intended to be encompassed by the present invention. Thus, various alternatives and modifications can be devised by those skilled in the art without departing from the invention. Accordingly, the present invention is intended to embrace all such alternatives, modifications, and variances that fall within the scope described above.

The invention claimed is:

1. An apparatus, comprising:

at least two strap ring components having a base portion and a retention portion, with the base portion having first and second ends and extending substantially linearly from the first end to the second end, with the retention portion having first and second ends and extending substantially curvilinearly from the first end to the second end, with the first end of the retention portion being integrally formed with the first end of the base portion, and with the second end of the retention portion being integrally formed with the second end of the base portion, such that the base portion of the strap ring component and the retention portion form a substantially D-shape;

a two-piece body garment comprising first and second sides, wherein the first side of the two-piece body garment is secured to the base portion of the at least two strap ring components;

a first connector item secured to the retention portion of a first of the at least two strap ring components, wherein the first connector item comprises a strap element formed back upon itself to create a loop having an interior surface, and wherein the interior surface of the first connector item slidingly engages the retention portion of the first of the at least two strap ring components;

a second connector item secured to the retention portion of a second of the at least two strap ring components, wherein the second connector item comprises a strap element formed back upon itself to create a loop having an interior surface, and wherein the interior surface of the second connector item slidingly engages the retention portion of the second of the at least two strap ring components;

a first shoulder harness secured around the first connector item, and a second shoulder harness secured around the second connector item.

2. The apparatus of claim 1, wherein the body garment further comprises a first padded cuff for receiving the first of the at least two strap ring components, and a second padded cuff for receiving the second of the at least two strap ring components.

3. The apparatus of claim 1, wherein the first connector item is movably secured to the retention portion of the first of the at least two strap ring components, and wherein the second connector item is movably secured to the retention portion of the second of the at least two strap ring components.

4. The apparatus of claim 1, wherein at least the first connector item comprises a belt.

5. The apparatus of claim 1, wherein at least the first connector item comprises a clip.

6. An apparatus, comprising:

at least two strap ring components having a base portion and a retention portion, with the base portion having first and second ends and extending substantially linearly from the first end to the second end, with the retention portion having first and second ends and extending substantially curvilinearly from the first end to the second end, with the first end of the retention portion being integrally formed with the first end of the base portion, and with the second end of the retention portion being integrally formed with the second end of the base portion, such that the base portion of the strap ring component and the retention portion form a substantially D-shape;

a two-piece body garment comprising first and second sides, wherein the first side of the two-piece body garment is secured to a first of the at least two strap ring components, and wherein the second side of the two-piece body garment is secured to a second of the at least two strap ring components;

a first connector item secured to the retention portion of the first of the at least two strap ring components, wherein the first connector item comprises a strap element formed back upon itself to create a loop having an interior surface, and wherein the interior surface of the first connector item slidingly engages the retention portion of the first of the at least two strap ring components;

a second connector item secured to the retention portion of the second of the at least two strap ring components, wherein the second connector item comprises a strap element formed back upon itself to create a loop having an interior surface, and wherein the interior surface of the second connector item slidingly engages the retention portion of the second of the at least two strap ring components;

a first shoulder harness secured around the first connector item;

a second shoulder harness secured around the second connector item;

a first padded cuff for receiving the first of the at least two strap ring components; and a second padded cuff for receiving the second of the at least two strap ring components.

7. The apparatus of claim 6, wherein the first connector item is movably secured to the retention portion of the first of the at least two strap ring components, and wherein the second connector item is movably secured to the retention portion of the second of the at least two strap ring components.

8. The apparatus of claim 6, wherein at least the first connector item further comprises a belt.

9. The apparatus of claim 6, wherein at least the first connector item further comprises a clip.

10. An apparatus, comprising:

at least two strap ring components having a base portion and a retention portion, with the base portion having first and second ends and extending substantially linearly from the first end to the second end, with the retention portion having first and second ends and extending substantially curvilinearly from the first end to the second end, with the first end of the retention portion being integrally formed with the first end of the base portion, and with the second end of the retention portion being integrally formed with the second end of the base portion, such that the base portion of the strap ring component and the retention portion form a substantially D-shape;

a two-piece body garment comprising first and second sides, wherein the first side of the two-piece body garment is secured to the base portion of the at least two strap ring components, wherein the body garment further comprises a first padded cuff for receiving a first of the at least two strap ring components, and a second padded cuff for receiving a second of the at least two strap ring components;

a first connector item secured to the retention portion of the first of the at least two strap ring components; and a second connector item secured to the retention portion of the second of the at least two strap ring components.

* * * * *